United States Patent [19]

Campbell

[11] Patent Number: 4,479,808

[45] Date of Patent: Oct. 30, 1984

[54] POKEHOLE SYSTEM FOR FIXED BED GASIFIER AND POKEHOLE UNIT

[75] Inventor: Hugh L. Campbell, Drums, Pa.

[73] Assignee: Dravo Corporation, Pittsburgh, Pa.

[21] Appl. No.: 521,004

[22] Filed: Aug. 8, 1983

[51] Int. Cl.[3] ..... C10J 3/20

[52] U.S. Cl. ..... 48/76; 48/87; 110/173 R; 110/175 R

[58] Field of Search ..... 48/87, 76, 85.2; 137/583; 266/271; 110/173 R, 175 R

[56] References Cited

U.S. PATENT DOCUMENTS

| | | | |
|---|---|---|---|
| 444,631 | 1/1891 | Goetz | 48/87 |
| 842,135 | 8/1906 | Campion et al. | 48/87 |
| 2,180,565 | 11/1939 | Thayer | 48/87 |
| 2,480,394 | 8/1949 | Cavers et al. | 266/41 |
| 2,687,347 | 8/1954 | Danulat | 48/87 |
| 4,134,738 | 1/1979 | Bress et al. | 48/85.2 |
| 4,211,536 | 7/1980 | Hamilton | 48/87 |
| 4,398,923 | 8/1983 | Hannigan | 48/87 |

*Primary Examiner*—Peter Kratz

*Attorney, Agent, or Firm*—Parmelee, Miller, Welsh & Kratz

[57] ABSTRACT

A fixed bed gasifier has an annular series of spaced pokehole units thereabout, each unit of which is an outwardly and upwardly extending tapered tube with an end closure having an eccentrically positioned hole through which a poker may be inserted to pass through the unit for poking the fire zone of the gasifier. The tapered tube opens the gasifier vessel at the reduction zone. The hole at the end closure is closed when not in use by a movable closure that is opened only when the poker is to be inserted. The movable closure is connected with an air valve that admits atmospheric air from a manifold encircling the gasifier, at a pressure slightly above the internal pressure in the gasifier, to the interior of the unit as the movable closure is operated to expose the hole at the end of the unit, forcing hot gases in the unit back into the gasifier in the reduction zone, and permitting air only to blow out the end of the unit just before the poker may be inserted and until the pokehole is again covered.

7 Claims, 4 Drawing Figures

POKEHOLE SYSTEM FOR FIXED BED GASIFIER AND POKEHOLE UNIT

SUBJECT OF THE INVENTION

This invention relates to the production of fuel gas from coal and similar carbonaceous fuel in a fixed bed gasifier and particularly to pokeholes through which manually operated rod-like pokers are temporarily thrust into the gasifier to measure the depth of the ash, keep the fuel bed open, and break up agglomerates of fuel and/or clinker, particularly above the grate in the level of the bed known as the "fire zone."

BACKGROUND

A fixed bed gasifier commonly comprises a vertical water jacketed cylindrical shell with means near the top for the introduction of fragmented coal and also near the top is an offtake through which gas produced from the coal is conducted from the interior of the shell. There is a grate structure within the shell located above the bottom of the shell providing an ash-pit below the grate as well as provision for the introduction of combustion air up through the grate for burning char, which is the residual coal material from which volatiles, gas and vapors, have been stripped in the operation of the gasifier. The burning of the char, which at this stage has become similar to coke, provides heat and hot gases for retorting the bed or column of coal above the fire zone. The grate is in the form of an eccentric stepped cone, the bottom tier of which extends across the entire diameter of the shell with several progressively smaller tiers terminating in a central, conical tier. The grate supports the entire burden of the charge within the cylindrical shell, starting with a bed of ash. Above the bed of ash is the fire zone, in which there is an exothermic oxidation of the char, and above the fire zone there is a reduction zone in which the gases produced by oxidation in the fire zone are reduced in an endothermic reaction. Above the reduction zone there is a depth of fragmented coal from which gas and volatiles are being distilled. Assuming the gasifier to be in operation, sufficient air is supplied through the grate and the overlying bed of ash to support combustion in a layer of devolatilized coal, or char, above the grate. The air supplies oxygen in a controlled volume to support fire in the fire zone only and without oxygen combustion cannot occur above this level. The heat of combustion and hot combustion gases rise through the bed of coal, and the coal immediately above the fire zone, in the reduction zone, is subjected to a chemical reaction which reduces the oxygen content of the gases and vapors entering this zone from the fire zone. The coal above the reduction zone becomes hot enough to release the volatiles, mostly gas and some vapors, which with combustion gases pass higher up through the bed to preheat the coal above, the gas, volatiles and spent combustion products then being withdrawn through the upper end of the gasifier for use as fuel.

As previously explained, distillation of the volatile products from the coal just above the fire zone converts the coal, stripped of its volatiles, into char. As the char in the fire zone burns, it produces ash and gases, and the newly formed char above the fire zone moves down to replace the char that has been oxidized and this cycle continues as long as the coal in the gasifier is replaced.

It is critical to this process that the fire zone and the ash bed be maintained at a fairly constant depth, which means that the air flow up through the grate must be uniformly distributed. If the depth of the ash bed diminishes to the extent that the hot char contacts the grate surface, warping, distortion, or other physical damage may occur. Conversely, if the depth of the ash bed should increase to the extent that the remaining available depth of coal is insufficient to permit the gasification reactions to occur, the resultant gas quality will diminish. If the air flow through some areas of the bed becomes clogged, the air will "channel" into the unclogged areas of least resistance and the gasification reactions will deteriorate.

It is for this reason that an attendant must be able to poke into and around the fire zone, primarily to periodically measure the depth of the ash bed, and based on this measurement, adjust the speed of the grate rotation to keep this depth constant, and occasionally, also to break up agglomerated masses and clinkers. To effectively accomplish this there must be "pokeholes" around the shell at spaced intervals. The pokeholes must be closed when they are not in use, and each has its individual closure, such as a hinged door, which is opened only when the attendant wants to use the poker in that sector of the bed to which the door and pokehole give access.

Since the pressure inside the gasifier is necessarily slightly higher than atmospheric pressure outside of it, the opening of a pokehole door is always accompanied with an outthrust of hot gases or vapors and usually dust, making the work of the attendant both disagreeable and hazardous. Pokehole doors are commonly located at the top of the gasifier vessel, or on the sides of the vessel above the reduction zone. In some cases, means are provided to allow the admission of inert gas or steam into the pokehole to prevent the outthrust of gases and dust. The introduction of such inert gases, however, results in a dilution of the gas stream flowing from the offtake from the vessel.

BRIEF DESCRIPTION OF THIS INVENTION

The present invention provides a generally tubular duct around each pokehole opening extending radially, and preferably at an upward slope from this shell with a movable closure plate at the outer end of the duct. The lower opening of the tubular duct extends through the wall of the gasifier vessel at the location of the reduction zone. The initiation of an opening movement of the closure plate starts the opening of a valve through which atmospheric air, which is at a slightly higher pressure than prevails inside the gasifier, enters the interior of the tubular duct and scavenges the interior of the duct free of accumulated gas, and dust if present, by forcing them back into the gasifier. When the closure plate has reached a position where the pokehole in the end closure is uncovered to permit the insertion of a poker, only clean atmospheric air will blow out toward the attendant instead of hot gases. Additionally, the introduction of clean atmospheric air into the reduction zone will not result in an explosive mixture of gases and air, as would be the case if air were introduced into the gasifier vessel above the reduction zone. When the attendant is through measuring the depth of the ash bed, or poking the fire at this position and has withdrawn the poker, he will move the cover plate toward the position to close the pokehole in the end closure, and, as he does so, the air valve will be turned to diminish the flow of air into the enclosure and then completely close off the air flow into the duct. At no time is sufficient air introduced into the gasifier to disturb normal functioning of the gasifier, or produce an explosive mixture, particularly since atmospheric pressure outside the gasifier is lower than the pressure in the gasifier and the air that enters the tubular enclosure from the air supply pipe can escape around the poker or enters the gasifier in the reduction zone, and keeps a sufficient pressure of air in the tubular enclosure to prevent the outflow of gasifier gases. The pressure inside the gasifier is produced by the air entering through the grates, and is always slightly less than the pressure in the air supply pipe. No control devices are thus required.

DETAILED DESCRIPTION OF THE DRAWINGS

Figure 1:
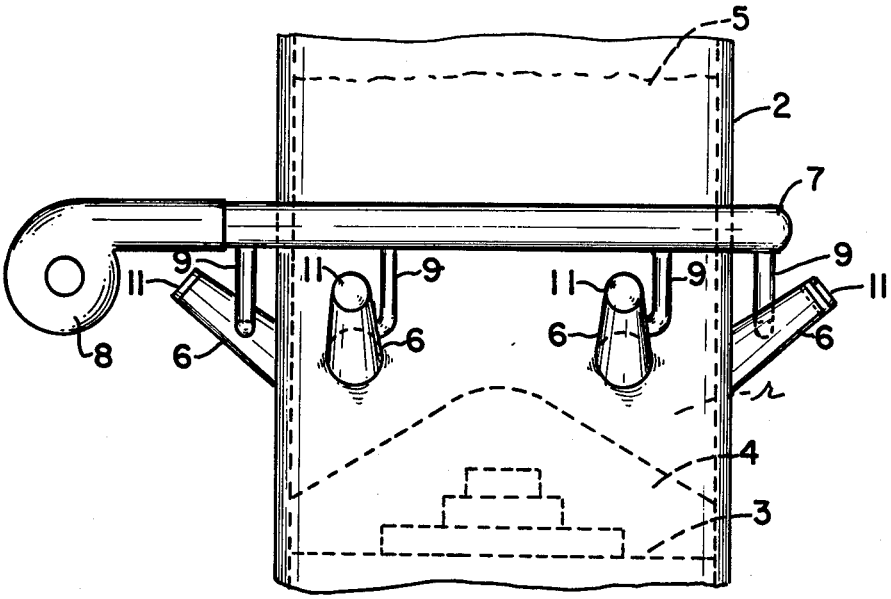
FIG. 1 is a somewhat schematic elevation of a gasifier showing a general arrangement of pokeholes as contemplated by this invention.

Looking first at FIG. 1, there is here represented in side elevation an intermediate section of a gasifier between the top and the bottom comprising a cylindrical vertical shell 2 of metal, surrounded by a water jacket. The grate 3 shown in dotted lines is a stepped cone spanning the full diameter of the interior of the shell. It is of known construction and details of air passages and ash drops are not shown. Ashes, of course, form above the grate but are not here shown separately from the fire zone 4 represented by the rounded dotted cone. Above the fire zone 4, there is a reduction zone r, and above the reduction zone a bed of fragmented coal, the height of which varies, but is here indicated by dotted line 5. As stated, the lower section of the fragmented coal, above the fire zone 4 is the reduction zone, r.

In the drawings a series of pokehole units, each indicated generally as 6 is shown along one side of the shell 2, but it is to be understood that this series of units encircles the entire gasifier being about equally spaced. Encircling the shell above the units is a manifold 7 connected with a source of atmospheric air, or moisture saturated atmospheric air, under pressure as represented by blower 8. While the drawing illustrates a separate blower 8 and source of atmospheric air, it should be understood that a blast air stream from the vessel, which is primary air to which moisture has been added to saturation, can be used as the source of air to the manifold 7. The pokehole closure assembly at each pokehole may hereinafter be sometimes referred to as a "unit". There is a down pipe 9 from the manifold 7 to each unit, the pipes opening tangentially into the sides of the respective units. At the outer end of each tube, the unit 6 has a closure and valve assembly indicated generally by an end plate assembly 11.

Figure 2:
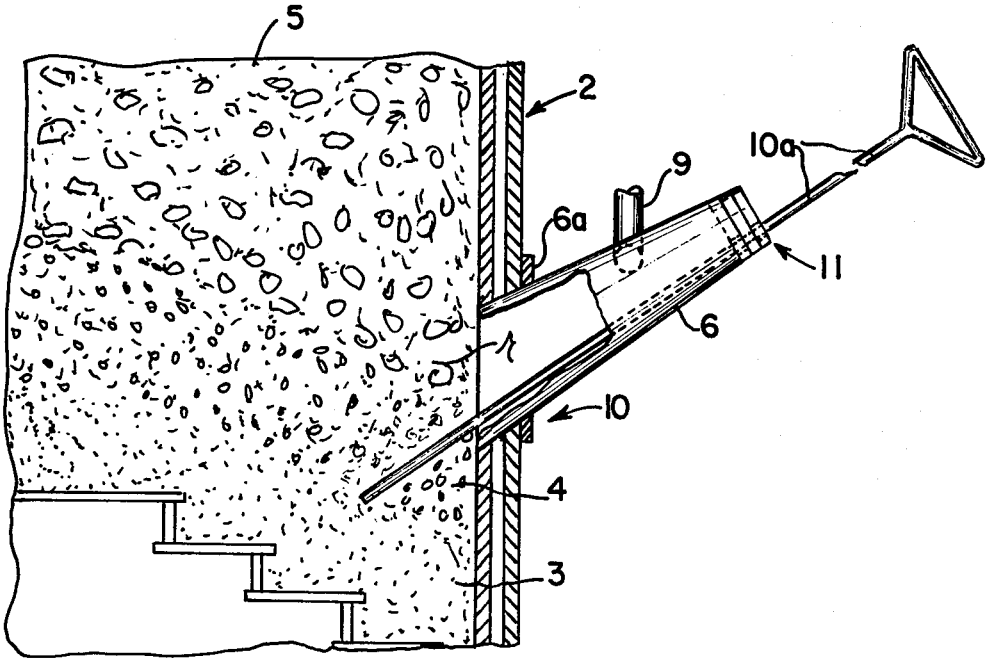
FIG. 2 is a fragmentary vertical section through a gasifier at the general level of one of the pokeholes showing the location of a pokehole with reference to the grate and overlying zones in the bed above the grate.

Referring now to FIG. 2, the fragmentary view is a vertical section through a portion of the gasifier which shows a portion only of a gasifier in the area of a single pokehole 10 and unit with a poker 10*a* in position to be used. The view shows the approximate location and relative size of the pokehole 10 through the shell with respect to the grate and the several zones in the gasifier. These are marked and approximate location indicated, along with the variation in cross-hatching. Starting with the ash zone immediately above the grate, the next is the fire zone, then the reduction zone with the overlying drying and devolatilizing zone, where coal preheating takes place. By locating the pokeholes at the reduction zone r, the poker 10*a* can be of a shorter length and more maneuverable, and any air which might enter the vessel through the pokehole will not cause an explosion problem.

Figure 4:
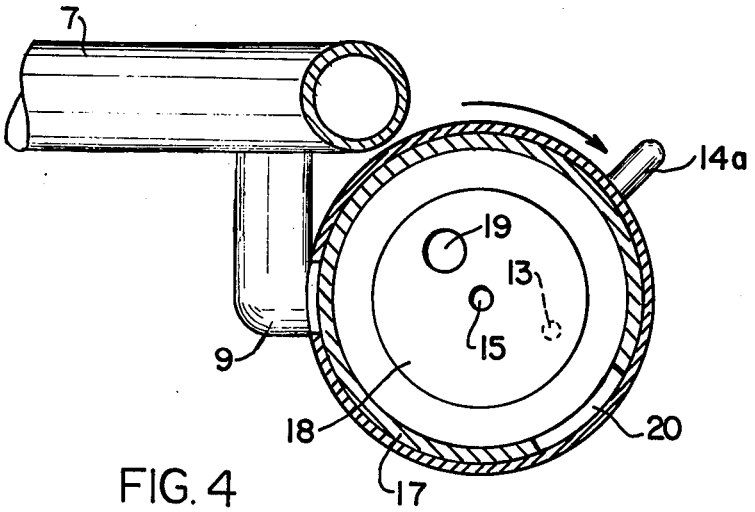
FIG. 4 is a transverse section in the plane of line IV—IV of FIG. 3, the plane of the section being at right angles to the longitudinal axis of the unit.

In FIG. 2 the unit is shown with its inner end only in longitudinal section, while in FIG. 4 the outer end portion of the tube is in transverse section. Reverting to FIG. 2, the preferred structure of each pokehole unit comprises a radially outward and upwardly sloping tube 6 of outwardly decreasing diameter. The inner end terminates in the pokehole 10 through the shell and flange 6*a* on the tube welded to the shell indicates the secure and tight joint between the shell and the tube. The diameter of the inner end of the tube is larger to allow for the angular movements, up and down and from side to side of the poker as it works in that area of the gasifier to which the particular pokehole gives access. The outward taper of the tube is not functionally necessary but, as shall hereinafter appear, need only be of a diameter to allow proper angular clearance for the poker where it fulcrums in the outer end of the unit.

Figure 3:
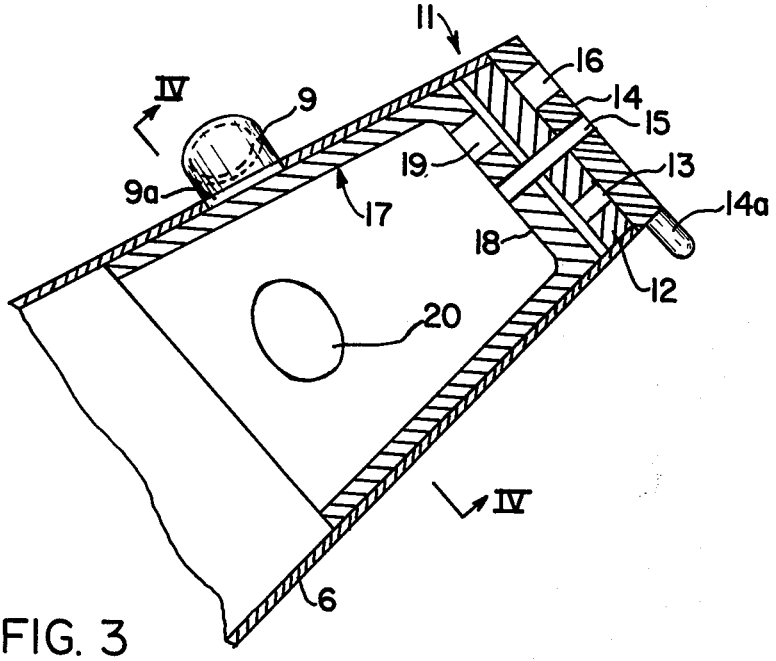
FIG. 3 is an enlarged longitudinal vertical section through the outer end of a single pokehole unit.

The outer end of each tube 6 has an end plate and closure assembly, which, as previously stated is designated generally as 11. As best seen in FIG. 3, this assembly comprises a fixed closure plate 12 through which is an eccentrically positioned hole 13 in the closure below the longitudinal axis of the tube. This hole 13 is of a diameter slightly larger than the diameter of the poker so that the poker passes freely therethrough with the walls of the hole being a fulcrum, at times, in using the poker.

On the face of plate 12 there is a concentric cover plate 14 on a concentric shaft 15 that passes through the end plate 12, so that 14 is concentric with end plate 12. Cover plate 14 lies flat against 12 and has a hole 16 therethrough eccentric to the center of rotation of 14, so that when 14 is rotated over the plate 12, the hole 16 may be brought into full register with hole 13. This registration of the respective hole 13 in the fixed end plate and hole 16 is necessary for insertion of the poker, but at all other times the cover plate 14 is rotated to a position where the two holes are out of register. The hole 16 is slightly larger in diameter than hole 13 so that with hole 13 used as a fulcrum for a poker, hole 16 provides clearance for the angular movement of the poker. An extension handle for rotating the cover 14 is indicated at 14*a*.

When the cover plate 14 is rotated, it rotates its pivot shaft 15 which passes through fixed end plate 12. There is a truncated hollow sleeve valve 17 coaxial with the interior of the conical tube 6. This valve has an end plate 18 adjacent the inner face of end plate 12 and it is fixed to the pivot shaft 15 of the cover plate, so that when the cover plate is rotated to bring the hole 16 into register with the hole 13 in the cover plate, the conical valve will be rotated inside the tube to the same extent. This will accomplish two things. First it will bring a hole 19 in the end plate 18 of the sleeve valve into register with the pokehole 13 in the end plate and hole 16 in the cover plate, so that the poker will pass freely through the three registering holes of the unit. Like hole 16, hole 19 is of larger diameter than hole 13 so as not to interfere with angular movement of the poker.

The second thing that will be accomplished by rotating the sleeve valve with the cover plate is that the sleeve valve has a peripheral slot-like port or arcuate opening 20 therethrough that will move into register with a port 9*a* in the side of the tube for the introduction of air from the down-pipe 9 through the port 9*a*, and through arcuate port 20 into the interior of the unit. This arcuate port 20 is so positioned in the cone that as the cover plate is rotated to simultaneously bring hole 16 and hole 19 into register with hole 13, the arcuate port 20 will start admitting air into the interior of the unit, forcing the contained gases from the gasifier out of the unit back into the gasifier whereby at the time the holes for insertion of the poker are in register, only atmosphere air will blow out the pokehole unit toward the attendant and will continue to blow out as long as the pokehole is open. The air will not be then cut off until the hole in the cover plate has been moved to a position where registration of the hole in the cover plate with the hole in the end plate has been completely terminated.

In the foregoing description, I have disclosed a simple embodiment of my invention, but with a differently arranged movable cover plate a different specific linkage may be more advantageous for transmitting motion to the sleeve valve or other valve that may be substituted.

I claim:

1. A pokehole unit for use in the reduction zone between a fire zone located above a grate and a top zone of reserve fuel in a vertical fixed bed gasifier through which a poker may be inserted for poking the fire in the gasifier comprising a tubular extension, projecting radially from an opening in the wall of the gasifier located at said reduction zone, having a closure at its outer end with an opening through which a poker may be removably inserted, a cover with a pokehole therethrough movable into and out of position over said opening, means defining a source of air under pressure and a valve and an associated conduit connected for introducing said air into the tubular extension when the cover is open and an operating linkage between the cover and the valve arranged to open the valve from the air source into the tubular extension when the cover is opened, and shut off the air from said source to the interior of the tubular extension when the cover is moved into position to close the opening.

2. A pokehole unit as defined in claim 1 in which the tubular extension projects both radially outward and upward from the opening in the gasifier.

3. A pokehole unit as defined in claim 2 in which the source of air under pressure comprises a manifold for successively supplying air to several tubular extensions projecting radially from openings in the wall of the gasifier located at said reduction zone, with a branch pipe leading from the manifold to each tubular extension, and each tubular extension has a separate valve between the manifold and the space inside the tubular extension to thereby selectively supply air from the manifold to each tubular extension as its cover plate is operated to open the pokehole in the end of the tubular extension, and close the flow of air from the manifold when the cover plate of a tubular extension is moved to closed position.

4. In a fixed bed gasifier having a vertical, generally cylindrical water jacketed shell with an internal grate extending across the interior of the shell separating the interior of the shell into an ash pit and air chamber below the grate, and which supports the burden of active gas-producing operations comprising, from the grate upward, an ash zone, a fire zone, a reduction zone and a top zone of reserve fuel which progresses downward as the coal beneath is stripped of gas in the reduction zone and moves downward to supply fuel to the fire zone where the fuel turns to ash which eventually passes through the grate, the improvement wherein:

(a) the shell has a series of openings therethrough at spaced intervals therearound, at the reduction zone in the gasifier, each of which is at a level and of a diameter to provide access for and freedom of angular movement to the end of a manually manipulated poker for poking a predetermined area of the fire zone between the top of the grate and the lower portion of the fuel in the reduction zone;

(b) a separate pokehole unit, of a generally tubular section, sealed to the shell around each opening and which extends radially outward and upward from the opening about which it is sealed, each unit having a fixed closure at its outer end with an opening therethrough of a diameter to freely receive a poker, the walls of the opening providing a fulcrum for manipulating the poker at diverse angles;

(c) a movable cover on the outer end of the unit, having a pokehole therethrough, movable into and out of position to close and open the opening through the fixed closure of the unit;

(d) means defining a source of atmospheric air, under pressure greater than the internal pressure inside the shell during operation of the gasifier, with a pipe leading from said source to each pokehole unit;

(e) a valve connected with said movable cover for controlling the air flow from said source to the interior of the unit to which it is connected for admitting scavenging atmospheric air into the unit when the movable cover exposes the opening in the fixed closure for insertion of a poker through the unit and shutting off the supply of air from said source to the unit when the movable cover closes the opening in the fixed closure.

5. The apparatus defined in claim 4 in which the valve is connected with the movable cover to admit air to the interior of the unit before the opening in the fixed closure is fully uncovered for the insertion of a poker, and to be completely closed to air flow only when the movable cover has completely covered the opening.

6. The apparatus as defined in claim 4 wherein the opening is eccentrically positioned in the end of the movable cover and the movable cover is fixed to a shaft, the axis of rotation of which is concentric with the axis of the tubular section, the movable cover having a pokehole therethrough that is moved by rotation of the movable cover into and out of register with the opening in the fixed closure of the tubular unit and which passes therethrough, the valve being a sleeve valve attached to said shaft for rotation with the shaft with a port in its periphery that is moved by rotation of the cover into open position with an air inlet port in the side of the unit in register with the port in the sleeve valve and when the movable cover is rotated to cover the opening, the sleeve valve is moved to a position where the port therein will be out of register with the air inlet port in the side wall of the tubular unit, the end of the sleeve valve being designed to allow a poker to pass endwise therethrough when the movable cover is moved to poker admitting position.

7. The apparatus as defined in claim 6 in which the sleeve valve has a closed end with an eccentric opening therethrough in line with the opening in the movable cover whereby the opening in the movable cover and the opening in the sleeve valve move simultaneously into or out of register.

* * * * *